US008756732B2

(12) United States Patent
Lachenbruch

(10) Patent No.: US 8,756,732 B2
(45) Date of Patent: Jun. 24, 2014

(54) METHOD AND APPARATUS FOR RELIEVING SHEAR INDUCED BY AN OCCUPANT SUPPORT

(71) Applicant: Hill-Rom Services, Inc., Batesville, IN (US)

(72) Inventor: Charles A Lachenbruch, Lakeway, TX (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

(21) Appl. No.: 13/732,634

(22) Filed: Jan. 2, 2013

(65) Prior Publication Data

US 2013/0174342 A1 Jul. 11, 2013

Related U.S. Application Data

(62) Division of application No. 12/704,600, filed on Feb. 12, 2010, now Pat. No. 8,365,330.

(51) Int. Cl.
*A47C 27/10* (2006.01)

(52) U.S. Cl.
USPC ..... 5/613; 5/713; 5/715

(58) Field of Classification Search
USPC ..... 5/613–618, 713, 715, 655.3
See application file for complete search history.

(56) References Cited

U.S. PATENT DOCUMENTS

| | | | | |
|---|---|---|---|---|
| 4,745,647 | A | 5/1988 | Goodwin | |
| 5,138,729 | A | 8/1992 | Ferrand | |
| 6,711,771 | B2 | 3/2004 | Cook et al. | |
| 2007/0266499 | A1 | 11/2007 | O'Keefe et al. | |
| 2007/0289067 | A1 * | 12/2007 | Buchanan et al. | 5/713 |
| 2008/0201858 | A1 | 8/2008 | Caminade | |

FOREIGN PATENT DOCUMENTS

WO 2009155595 A2 12/2009

OTHER PUBLICATIONS

European Search Report accompanied by the Examiner's Preliminary Opinion, "Application No. EP 11153024", (Jan. 23, 2012), The Hague.

* cited by examiner

*Primary Examiner* — Fredrick Conley
(74) *Attorney, Agent, or Firm* — Kenneth C. Baran

(57) ABSTRACT

A method for operating an occupant support, at least part of which is orientation adjustable relative to other parts of the occupant support, is disclosed. The method comprises providing, in response to a change of orientation of the orientation adjustable part, a relatively lower occupant/support interface pressure (OSIP) at a location A and a relatively higher OSIP at a location B followed by providing a relatively higher OSIP at the location A and a relatively lower OSIP at the location B.

13 Claims, 18 Drawing Sheets

METHOD AND APPARATUS FOR RELIEVING SHEAR INDUCED BY AN OCCUPANT SUPPORT

This is a divisional of U.S. application Ser. No. 12/704,600 entitled "Method and Apparatus for Relieving Shear Induced by an Occupant Support" filed on Feb. 12, 2010, the contents of which are incorporated herein by reference.

TECHNICAL FIELD

The subject matter described herein relates to occupant supports with adjustable components, adjustment of which may impart shear to the occupant's skin and other soft tissues. In particular the subject matter relates to methods and apparatus for relieving (including preventing or reducing) such shear. One example application for the methods and apparatus is in a hospital bed having an orientation adjustable deck section.

BACKGROUND

Hospital beds may include a base frame, an elevatable frame whose height can be adjusted relative to the base frame, a deck comprising one or more orientation adjustable deck sections, and a mattress supported by the deck. One type of deck has a head or upper body section corresponding to an occupant's back neck and head, a seat section corresponding to the occupant's buttocks, a thigh section corresponding to the occupant's thighs, and a calf section corresponding to the occupant's calves and feet. All of the sections except the seat section are orientation adjustable. Adjustments made to one of the adjustable deck sections changes the orientation of the portion of the mattress resting on that deck section. One known type of mattress is an air mattress comprising one or more inflatable bladders.

When the head section undergoes a change of orientation from a horizontal (0°) orientation to a non-horizontal orientation, interior portions of the occupant's body, particularly the skeleton, typically translate toward the foot of the mattress. However, friction at the occupant/mattress interface can prevent the occupant's skin and other soft tissue from undergoing a corresponding translation. As a result, the soft tissue becomes stretched. The resulting shear stress on the occupant's skin, particularly if sustained over a long period of time, is associated with skin breakdown due to, for example, interference with blood flow, lymphatic function and shearing of the dermal/epidermal layer.

It is, therefore, desirable to develop beds, mattresses, and methods to relieve the shear and tissue stretch associated with changes in the orientation of the head section or other orientation adjustable components of the bed.

SUMMARY

The subject matter described herein includes a bed comprising a frame with at least one orientation adjustable section, a mattress supported by the frame and having at least one A bladder and at least one B bladder. The bladders are inflatable and deflatable out of phase with each other in coordination with at least one of a) issuance of a command for the frame section to change orientation and b) an actual change in orientation of the frame section. Also described is a method for operating an occupant support at least part of which is orientation adjustable relative to other parts of the occupant support. The method comprises providing, in response to a change of orientation of the orientation adjustable part, a relatively lower occupant/support interface pressure (OSIP) at a location A and a relatively higher OSIP at a location B followed by providing a relatively higher OSIP at the location A and a relatively lower OSIP at the location B.

BRIEF DESCRIPTION OF THE DRAWINGS

The foregoing and other features of the various embodiments of the method and apparatus described herein will become more apparent from the following detailed description and the accompanying drawings in which:

FIG. 1 shows a hospital bed 20 having a head end 22, a foot end 24 longitudinally spaced from the head end, a right side 26, and a left side 28 laterally spaced from the right side. The bed includes a base frame 32 and an elevatable frame 34. A lift system, represented in part by head end canister lift 38, and a similar foot end canister lift (not visible), renders the elevatable frame height adjustable relative to the base frame. The lift system also makes the base frame adjustable to a head down (Trendelenberg) inclination or a foot down (reverse Trendelenberg) inclination as indicated by inclination angle $\alpha$ seen in FIG. 4. The elevatable frame includes a deck comprised of a head or upper body deck section 44, a seat deck section 46, a thigh deck section 48 and a calf deck section 50. The head, thigh and calf sections are orientation adjustable as indicated by the angles $\beta$, $\theta$, and $\delta$ seen in FIG. 3. A user commands adjustments to the elevation, inclination and deck section orientations by way of a user interface, such as a keypad 54.

An occupant support in the form of an air mattress 58 rests on the deck. The air mattress is shown in phantom in FIG. 1. The air mattress includes air bladders 60 inflated to an intra-bladder inflation pressure. FIGS. 2 and 3 show an alternative mattress having air bladders overlying the upper body, seat and thigh sections and a non-pneumatic portion (e.g. foam) overlying the calf deck section.

FIGS. 2 and 3 are schematic illustrations showing shear and tissue stretch being imparted to a bed occupant's skin as a result of elevating the head deck section 44 from a flat orientation to a higher (non-horizontal) orientation and also showing a mattress 58 for relieving (including preventing or reducing) the shear and stretching. The pressure exerted on the occupant at a given location on his or her body is referred to as occupant/support interface pressure and is abbreviated herein as OSIP. FIG. 2 is a baseline depicting the deck sections at a flat (0°) orientation and the occupant's skeleton (as represented by spine 64), skin 66 and other soft tissue 68 in an initial state. The illustration includes hash marks extending through the soft tissue from the spine to the skin. The perpendicularity of the hash marks relative to the spine and skin reveals the absence of any noteworthy shear and tissue stretch. FIG. 3 shows the result of the head deck section having been elevated to an orientation $\beta_1$. Elevation of the head section has, for the most part, translated the occupant a distance d toward the foot of the bed. However friction at the occupant/mattress interface has prevented a corresponding translation of the occupant's skin thereby undesirably stretching the skin and soft tissue as indicated by the non-perpendicularity of the hash marks. The tendency of the occupant's skin and soft tissue to stretch increases with increasing OSIP.

FIG. 5 is a schematic illustration of the bed having a mattress 58 for preventing, reducing or relieving the shear and stretching. The mattress includes at least two classes of air bladders 60. The mattress has at least one bladder of each class and preferably multiple bladders of each class. The illustrated mattress includes exactly two classes of bladders, one designated class A and one designated class B, and includes multiple bladders of each class. The A and B bladders may occupy the entire longitudinal length of the mattress, however it may be sufficient for the classified bladders to reside exclusively in a more limited longitudinal zone of the mattress, for example a zone of the mattress intended to support an occupant from the occupant's thighs to the base of the occupant's neck. In the illustrated bed the longitudinally limited zone encompasses the head, seat and thigh sections 44, 46, 48.

Referring to FIG. 6, each bladder has a vertical dimension V, a longitudinal dimension $D_{LONG}$, a lateral dimension $D_{LAT}$ and an aspect ratio. The aspect ratio is the vertical dimension divided by either the longitudinal dimension or the lateral dimension, whichever is smaller. The mattress of FIGS. 5 and 6 has a longitudinal dimension smaller than its lateral dimension, hence its aspect ratio is $V/D_{LONG}$.

Figure 1:
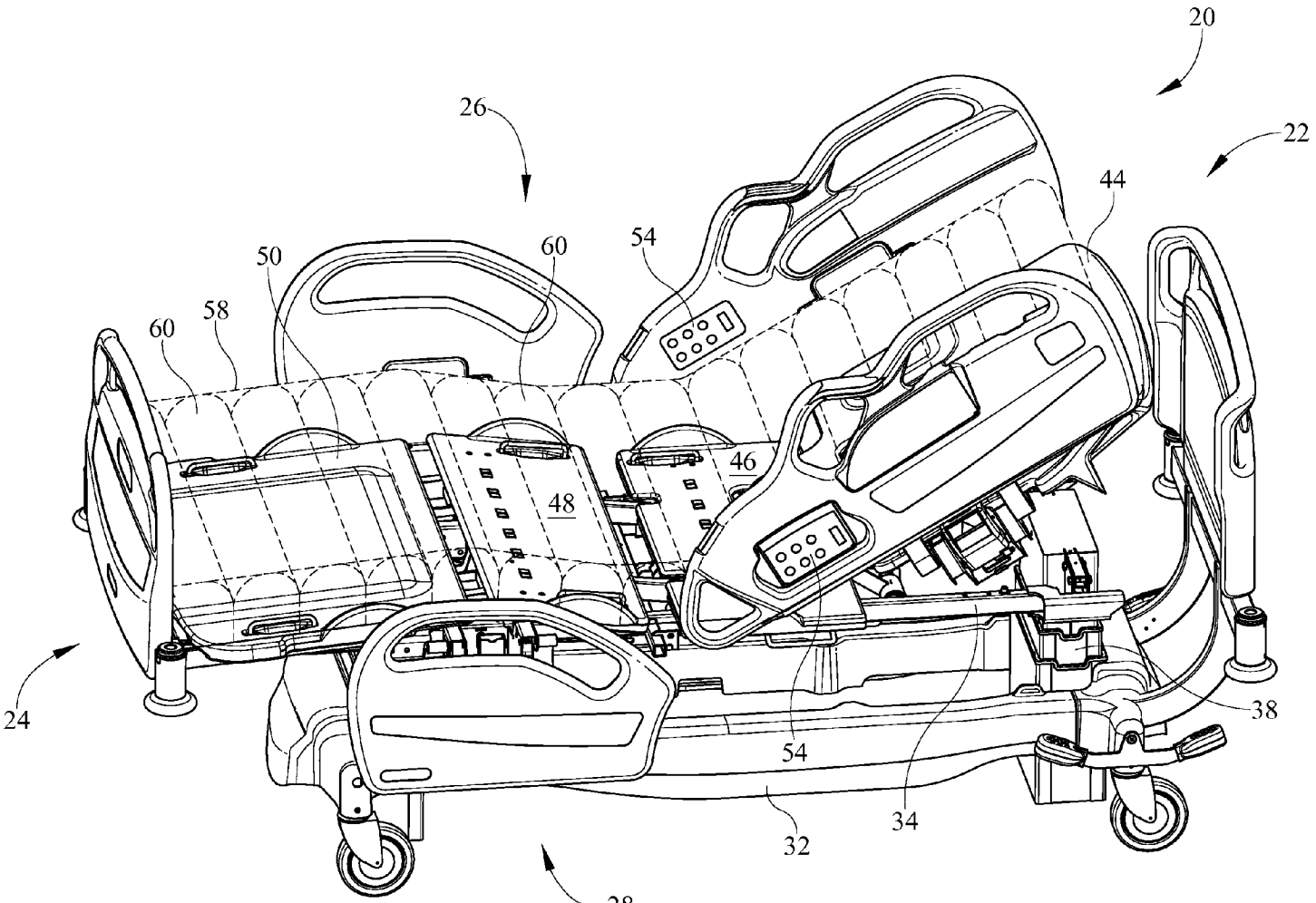
FIG. 1 is a perspective view of a hospital bed having an air mattress comprising multiple bladders.
Figure 2:
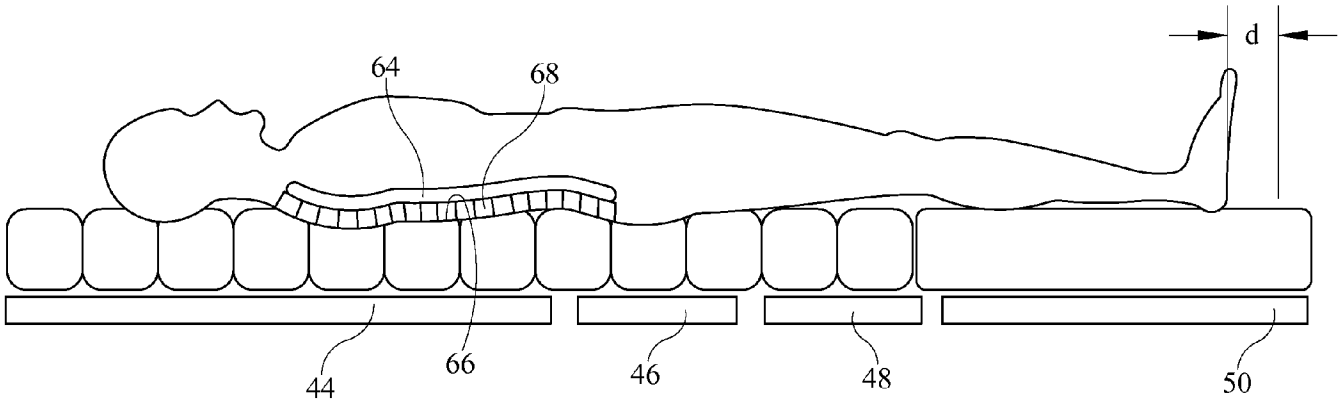
FIGS. 2 and 3 are schematic, right side elevation views of a bed with a mattress having air bladders and a non-pneumatic (e.g. foam) section illustrating various orientation adjustments and showing how an orientation adjustment of the bed upper body section induces shear and tissue stretch on a bed occupant.
Figure 3:
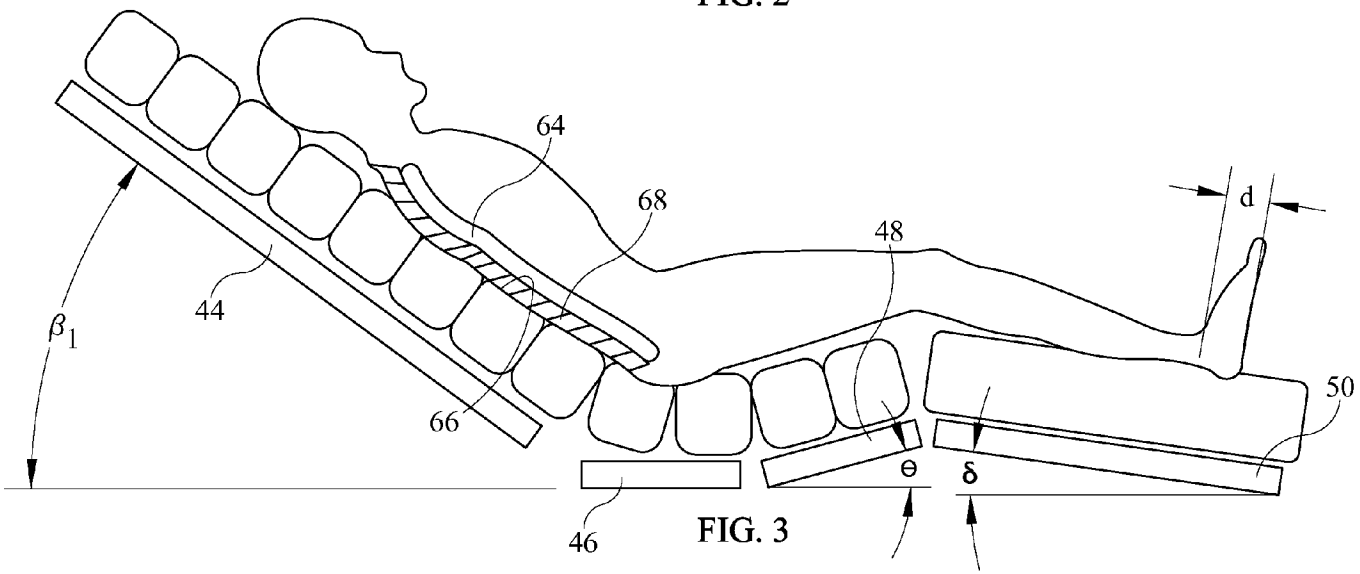
Figure 4:
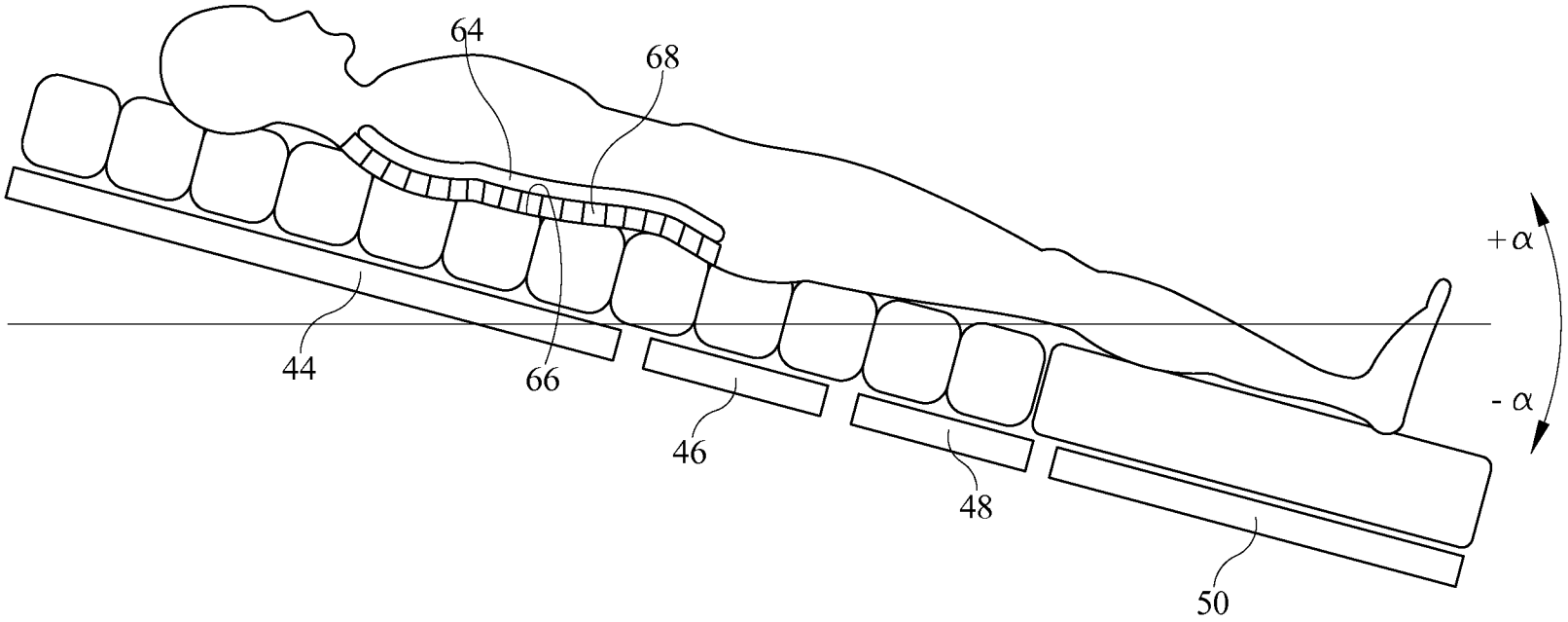
FIG. 4 is a view similar to FIG. 2 illustrating the bed in a foot-down orientation and indicating that the bed can also be placed in a head-down orientation.
Figure 5:
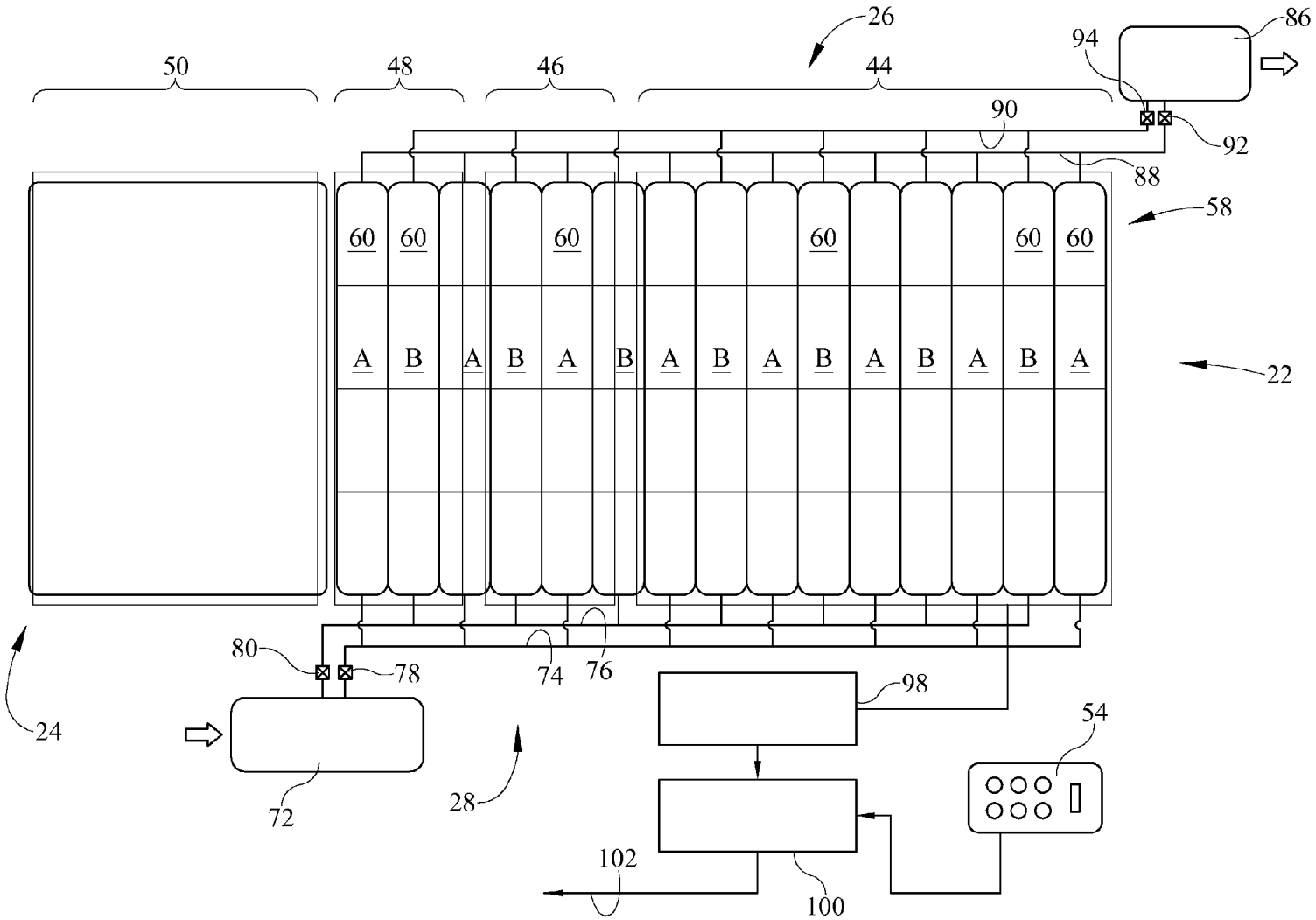
FIG. 5 is a schematic plan view of the bed showing classified air bladders and an architecture for connecting the air bladders to a compressor and a pump.
Figure 6:
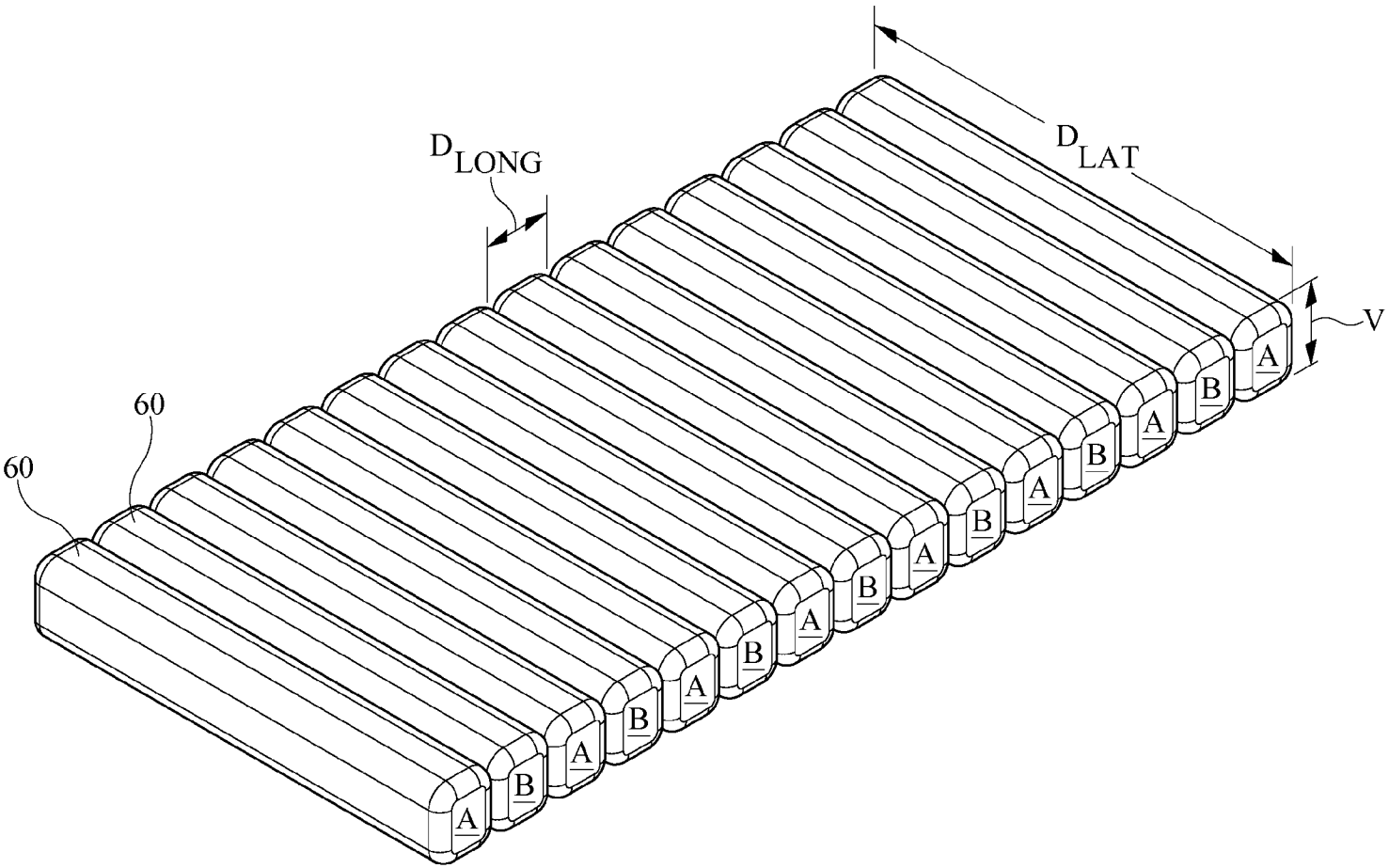
FIG. 6 is a perspective view of a bladder configuration in which the lateral bladder dimension exceeds the longitudinal bladder dimension.

Referring back to FIG. 5 the bed also includes a blower or compressor 72 for supplying pressurized air to the bladders, an A supply manifold 74 in fluid communication with all the A bladders, and a B supply manifold 76 in fluid communication with all the B bladders. A and B supply valves 78, 80 direct pressurized air from the compressor to the A supply manifold, the B supply manifold or both. The bed also includes a pump 86 for evacuating air from the bladders, an A discharge manifold 88 in fluid communication with all the A bladders, and a B discharge manifold 90 in fluid communication with all the B bladders. A and B discharge valves 92, 94 place the pump in fluid communication with the A discharge manifold, the B discharge manifold or both. The bed also includes a sensor 98 for sensing the orientation $\beta$ of the head deck section 44. A controller 100 receives inputs from the sensor and user keypad 54 and delivers control signals 102 to the compressor, pump, and valves.

The controller, compressor, pump and valves allow the A and B bladders to be inflatable and deflatable out of phase with each other in coordination with, for example, issuance of a command for the head deck section 44 to change orientation or in coordination with an actual change in orientation of the head deck section.

Figure 7:
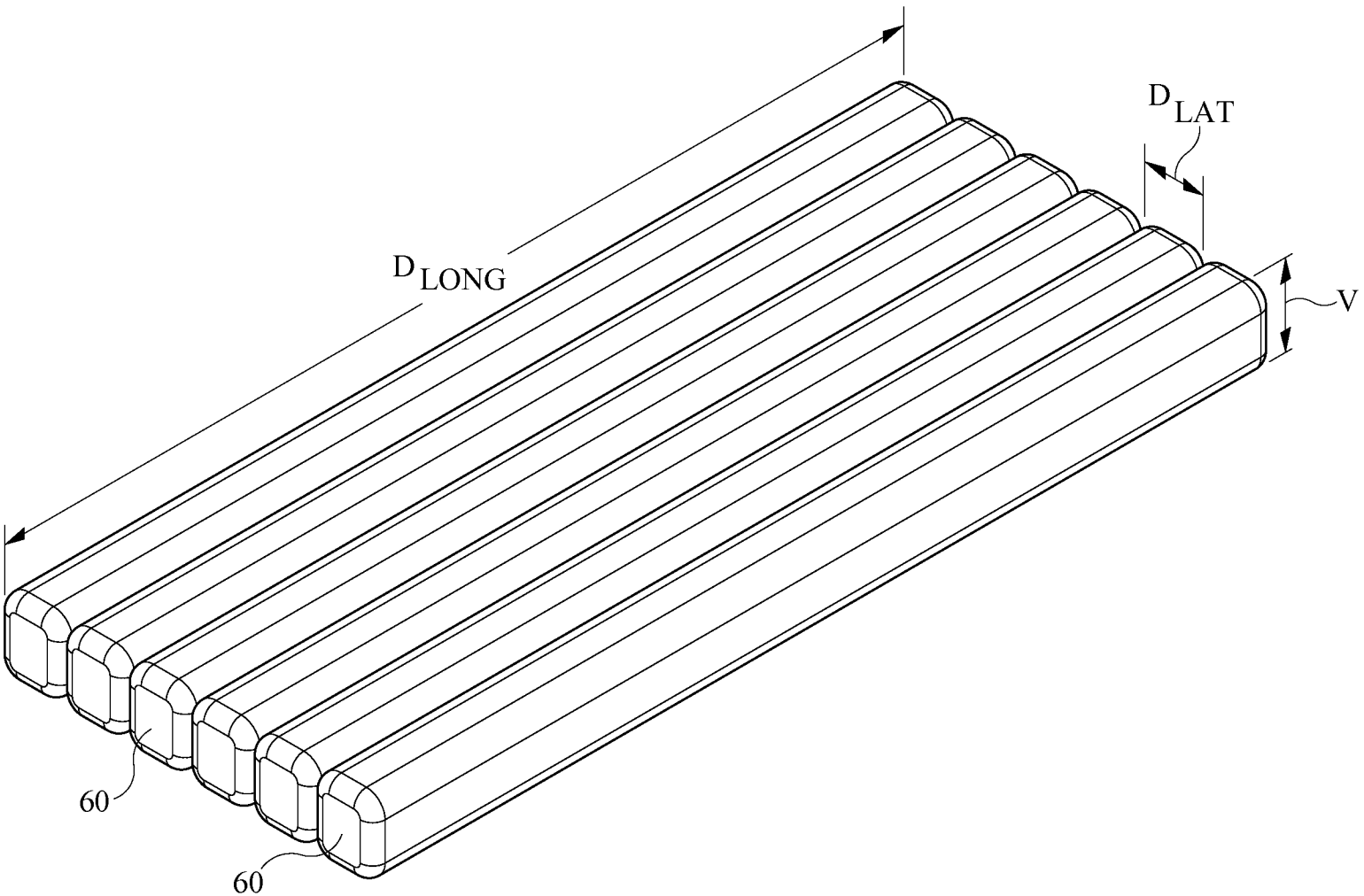
FIG. 7 is a perspective view of a bladder configuration in which the longitudinal bladder dimension exceeds the lateral bladder dimension.

FIG. 7 shows an alternate bladder configuration in which the bladders are arranged so that their longitudinal dimension $D_{LONG}$ exceeds their lateral dimension $D_{LAT}$. Accordingly, their aspect ratio, the vertical dimension divided by the smaller of the longitudinal and lateral dimension, is $V/D_{LAT}$.

Figure 8:
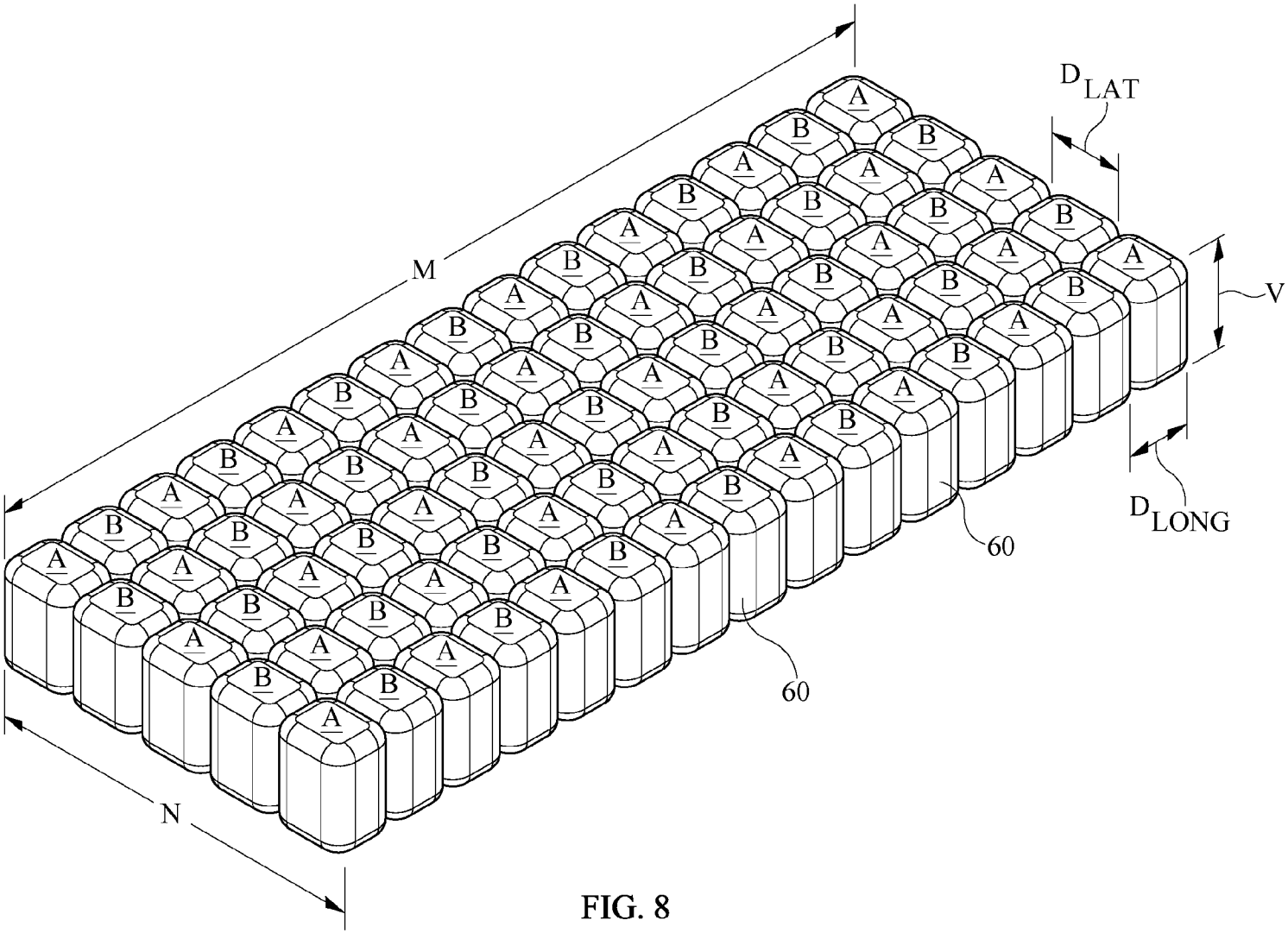
FIG. 8 is a perspective view of a bladder configuration in which the bladders are arranged as cells of an M by N dimensional matrix or lattice.

FIG. 8 shows yet another alternate bladder configuration in which two classes of bladders are arranged as cells of an M by N dimensional matrix or lattice where both M and N are greater than 1.

Figure 9:
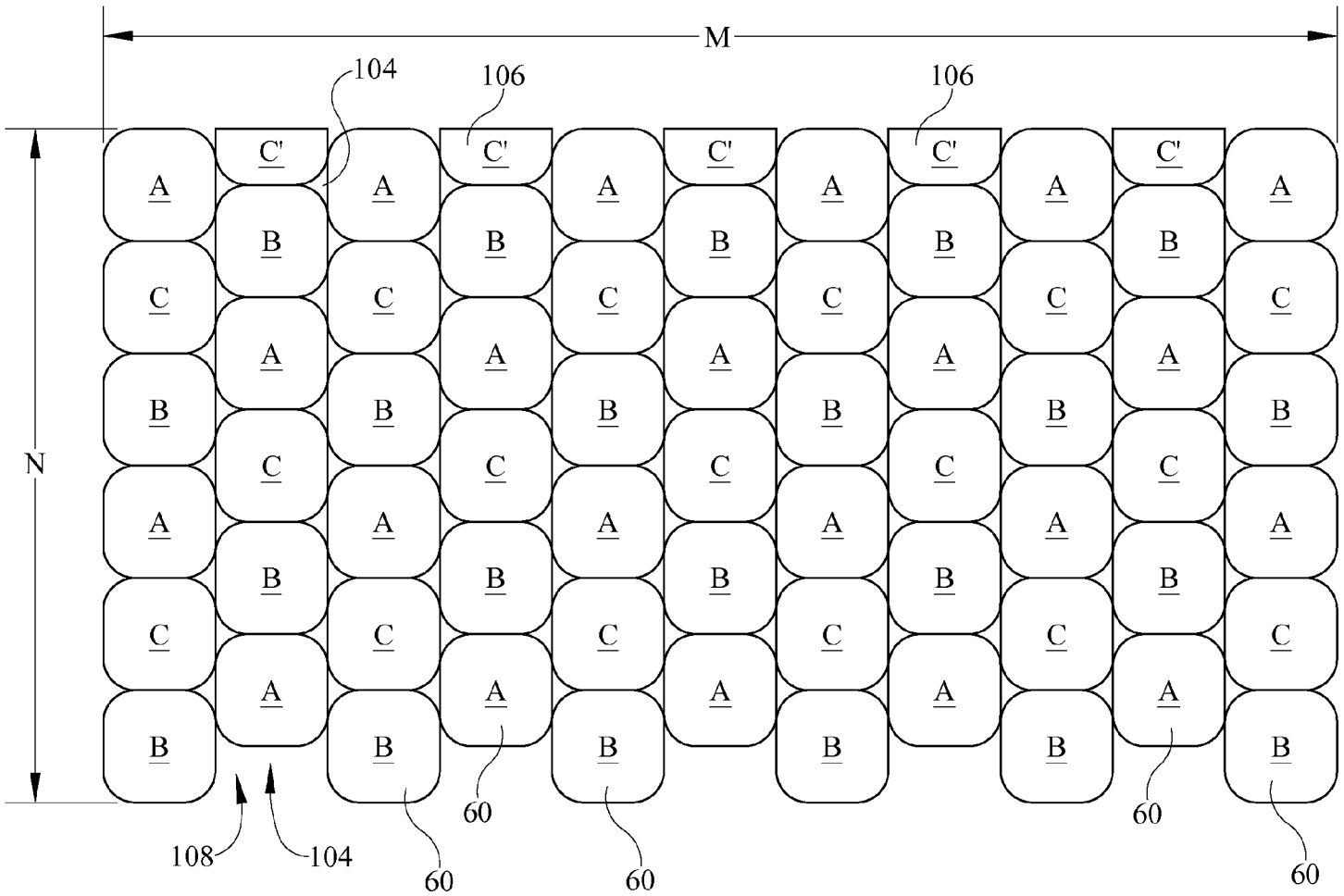
FIG. 9 is a plan view of a bladder configuration in which the bladders are arranged as cells of a staggered M by N dimensional matrix or lattice.

FIG. 9 shows still another bladder configuration in which three classes of bladders, A, B and C are arranged as cells of an M by N dimensional matrix or lattice where both M and N are greater than 1. The longitudinally distributed interbladder regions 104 along the edges of the mattress can be occupied by mini-bladders 106 as shown on the side of the mattress closer to the top of the illustration or left as voids 108 as shown on the other side.

Figure 10:
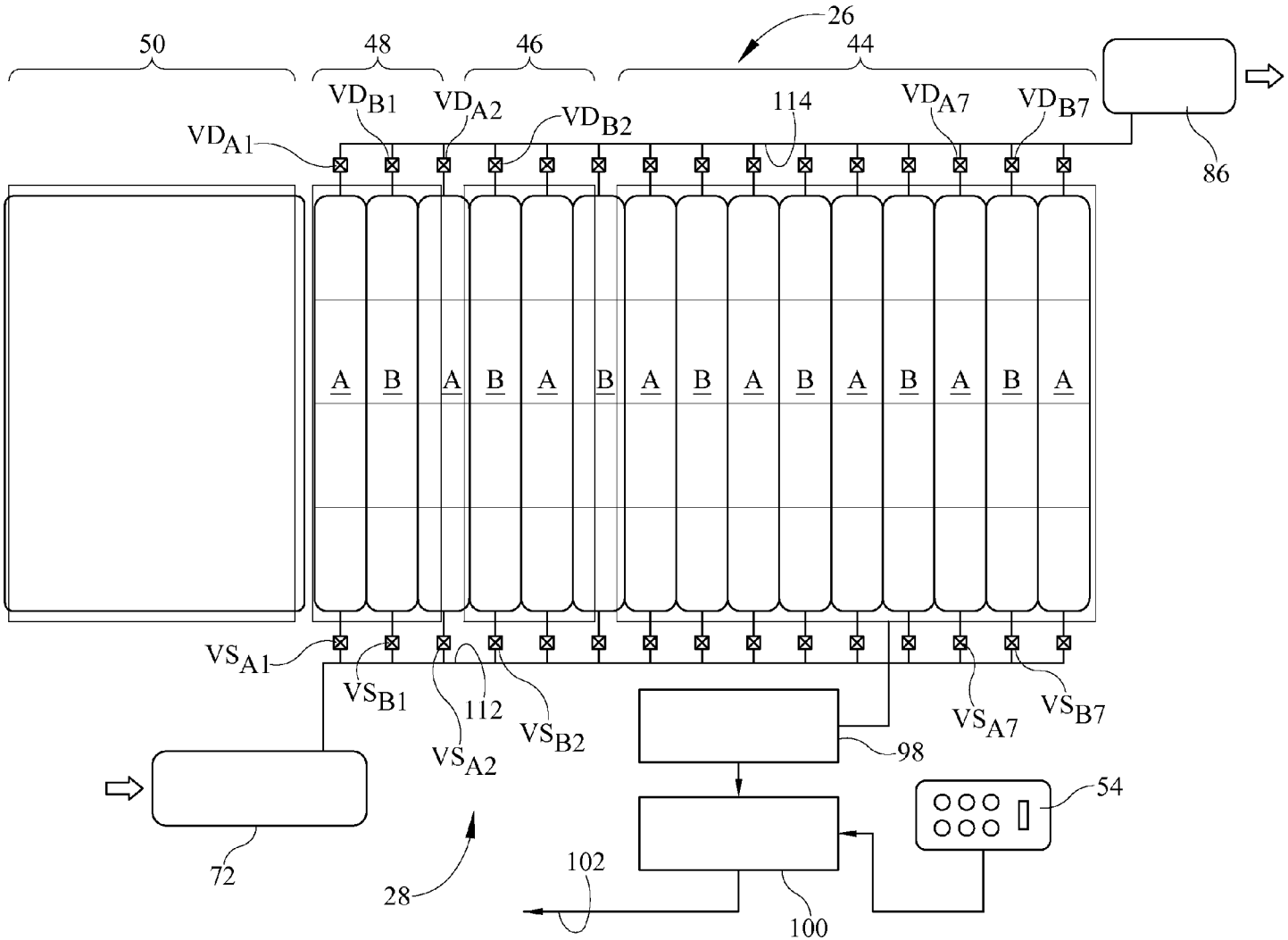
FIG. 10 is a view similar to FIG. 5 showing classified air bladders and an alternate architecture for connecting the air bladders to a compressor and a pump.

FIG. 10 shows an alternate architecture having a blower or compressor 72 for supplying pressurized air to the bladders, a common supply manifold 112, and bladder specific supply valves $VS_{A1}$, $VS_{A2}$, $VS_{A3}$, . . . $VS_{An}$ and $VS_{B1}$, $VS_{B2}$, $VS_{B3}$, . . . $VS_{Bn}$ for placing the supply manifold, and therefore the compressor, in communication with selected A and/or B bladders. The alternate architecture also includes a pump 86 for evacuating air from the bladders, a common discharge manifold 114, and bladder specific discharge valves $VD_{A1}$, $VD_{A2}$ $VD_{A3}$, . . . $VD_{An}$ and $VD_{B1}$, $VD_{B2}$, $VD_{B3}$, . . . $VD_{Bn}$ for placing the discharge manifold, and therefore the pump, in communication with selected A and/or B bladders. Angle sensor 98 senses the orientation $\beta$ of the head deck section 44. Controller 100 receives inputs from the sensor and keypad and issues control signals 102 to the compressor, pump and valves.

Figure 11:
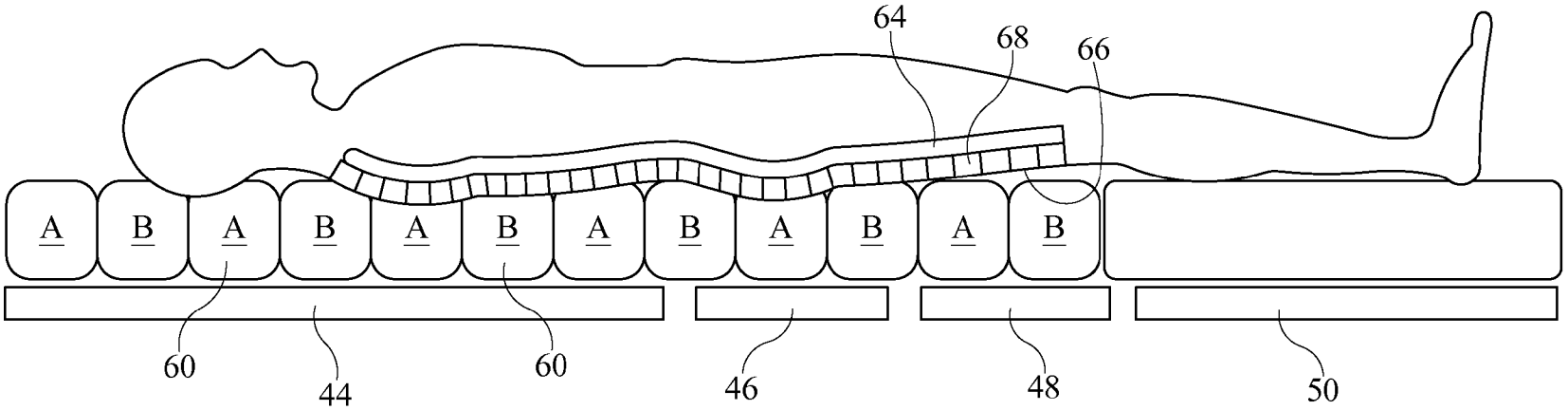
FIGS. 11-15 are a sequence of views showing how an occupant lying on a mattress is subject to shear and tissue stretch as a consequence of a change in orientation of a section of the bed and how the classified bladders are used to relieve the shear and tissue stretch.
Figure 12:
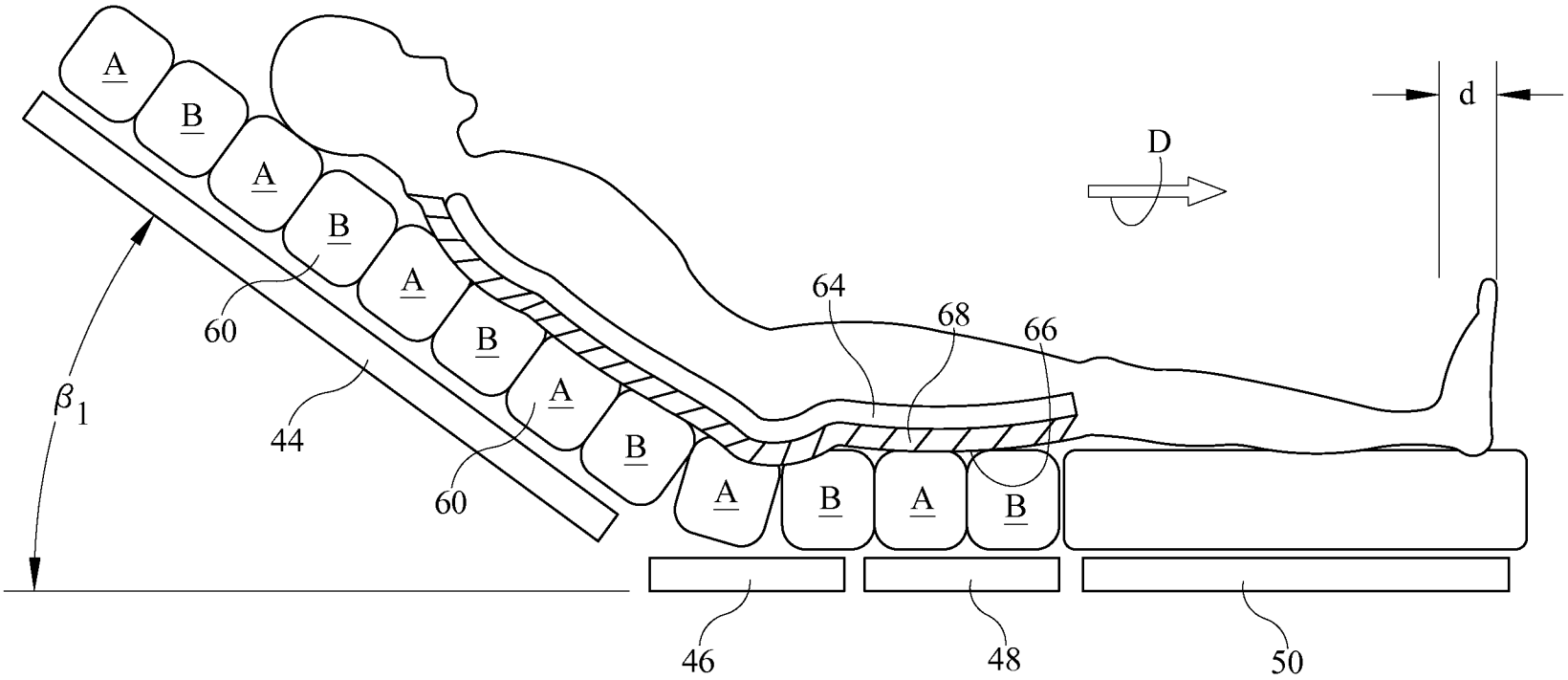
Figure 13:
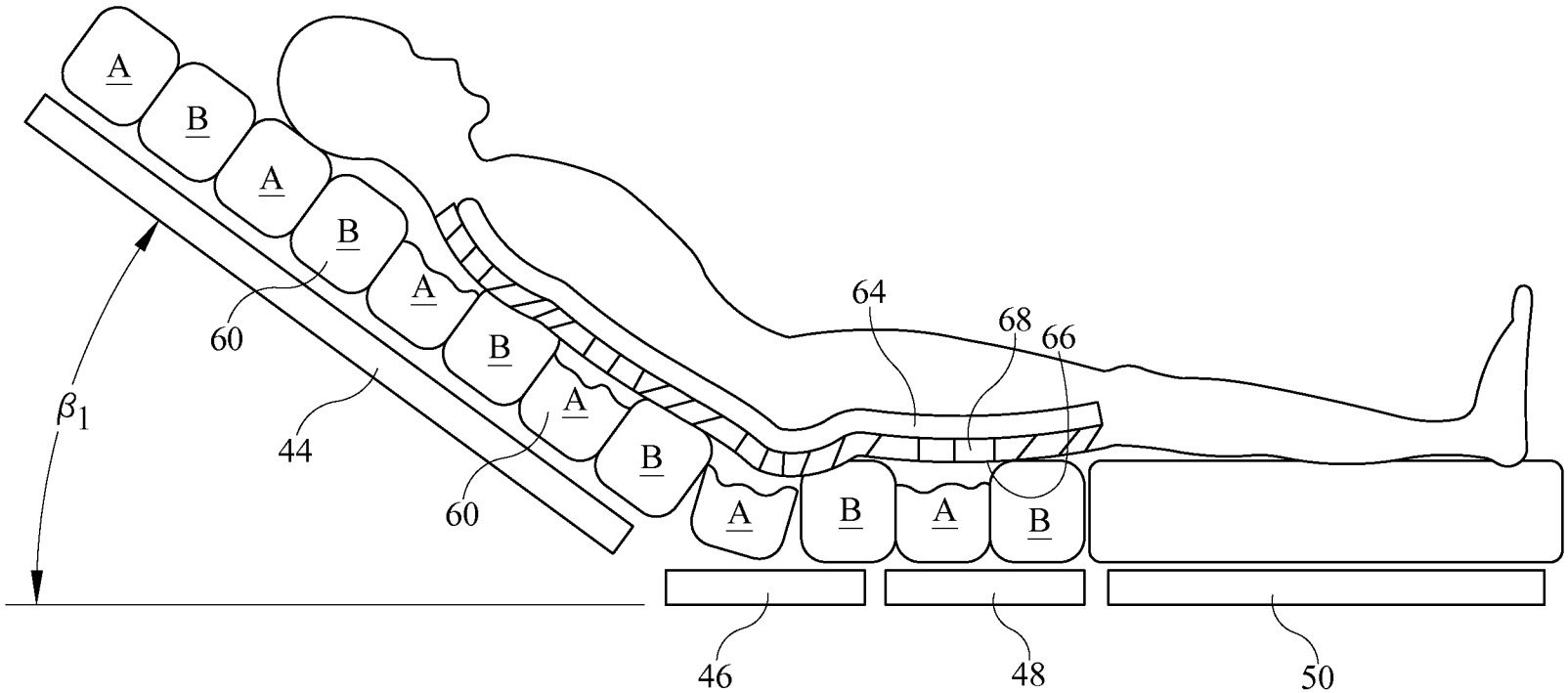

In operation, a user employs the keypad 54 to command a change of orientation of the head section 44, for example from horizontal (0°) to a non-horizontal orientation $\beta_1$. Prior to the change of orientation both the A and B bladders are in an inflated state (FIG. 11). As the orientation changes, the occupant's body migrates in direction D, and the occupant's tissue is stretched as already described (FIG. 12). As seen in FIG. 13 the stretching is relieved by providing a relatively lower OSIP at locations A (corresponding to the class A bladders) and providing a relatively higher OSIP at locations B (corresponding to the class B bladders). The phrases "relatively lower" and "relatively higher" refer to the OSIP's at locations A and B relative to each other, not relative to a pre-existing baseline OSIP. As seen in FIG. 13, the lower OSIP at locations A allows the tissue stretched at those locations to return to its relaxed state while the concurrent, relatively higher OSIP at locations B provides ongoing support to the occupant. The relatively lower OSIP at locations A is achieved by opening the appropriate discharge valve or valves (valve 92 of FIG. 5; valves $VD_A$ of FIG. 10) and operating the pump 86. The relatively higher OSIP at locations B is achieved by simply leaving the B bladders in their pre-existing state of normal inflation. Alternatively, the B bladders can be temporarily overinflated if desired by opening the appropriate valves (valve 80 of FIG. 5; valves $VS_B$ of FIG. 10) and operating the compressor 72. FIG. 13 shows the class A bladders sufficiently depressurized to achieve substantially zero OSIP.

Figure 14:
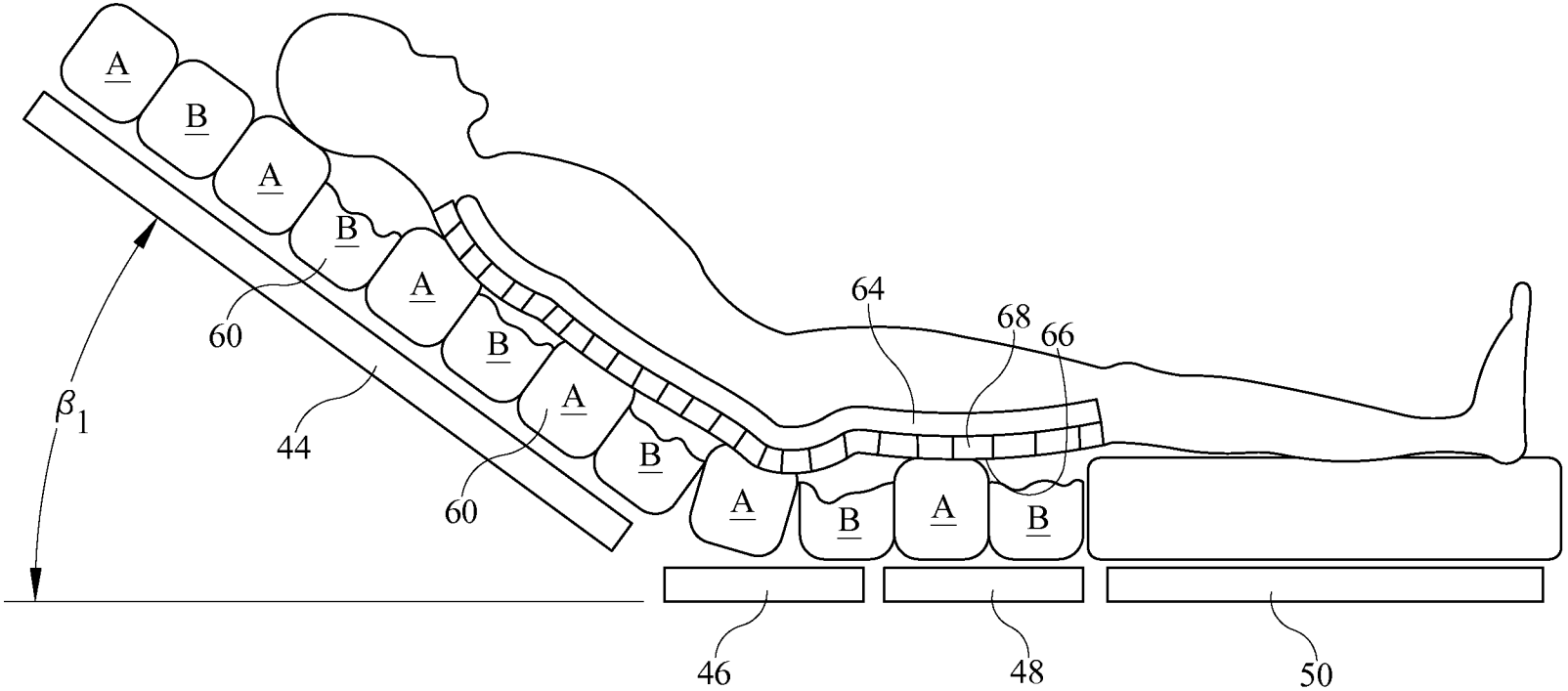

Subsequently, and as seen in FIG. 14, a relatively higher OSIP is provided at locations A (corresponding to the class A bladders) and a relatively lower OSIP is provided at locations B (corresponding to the class B bladders). The relatively lower OSIP at locations B allows the occupant's tissue stretched at those locations to return to its relaxed state. The concurrent, relatively higher OSIP at locations A now provides support to the occupant. The relatively lower OSIP at locations B is achieved by opening the appropriate discharge valve or valves (valve 94 of FIG. 5; valves $VD_B$ of FIG. 10) and operating the pump. The relatively higher OSIP at locations A is achieved by opening the appropriate supply valve or valves (valve 78 of FIG. 5; valves $VS_A$ of FIG. 10) and operating the compressor to repressurize the A bladders. FIG. 14 shows the class B bladders sufficiently depressurized to achieve substantially zero OSIP.

Figure 15:
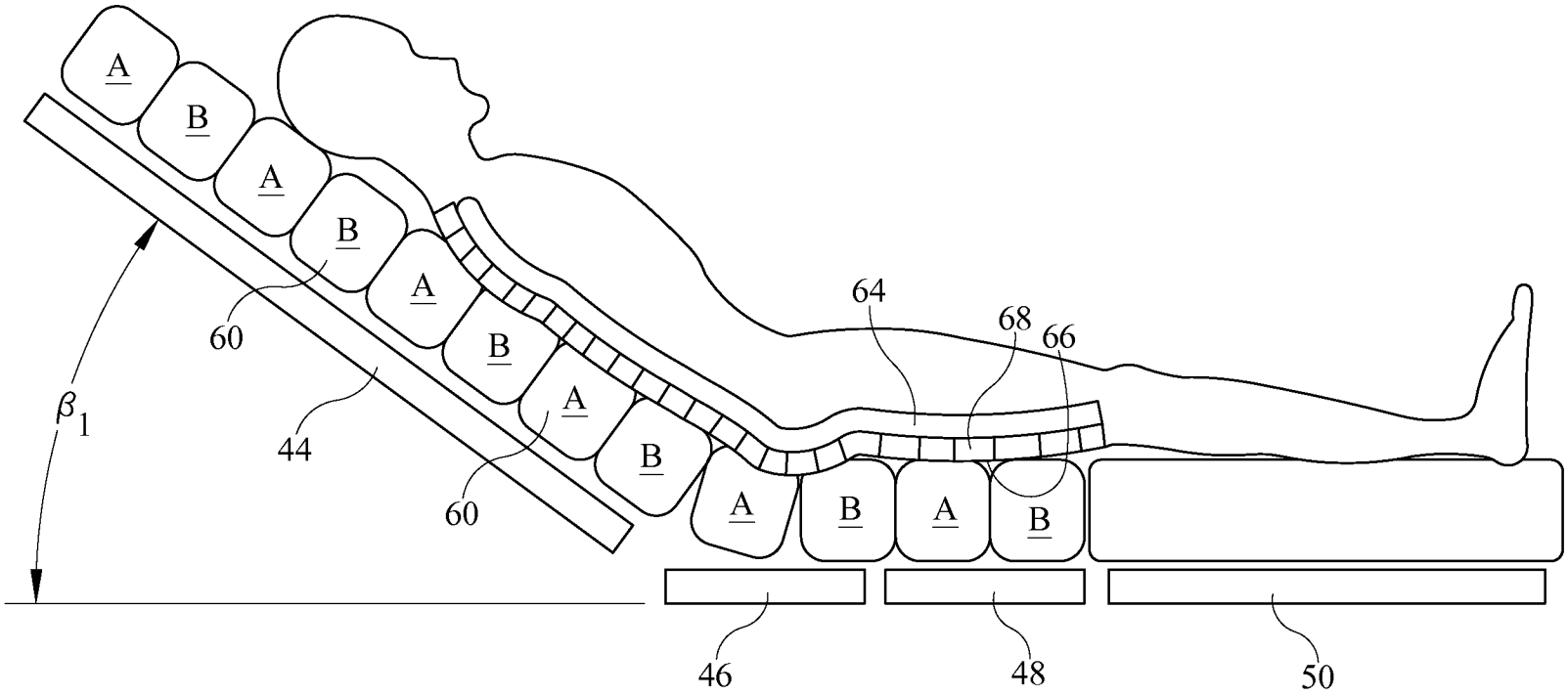

Finally, the B bladders are reinflated to normal inflation pressure as seen in FIG. 15.

The foregoing example achieves relatively lower and higher pressures in the bladders by evacuating air from each bladder desired to be in a relatively low pressure state (bladders A of FIG. 13 and bladders B of FIG. 14) and leaving the bladders desired to be in a relatively higher pressure state in their pre-existing state of normal inflation or overinflating those bladders (bladders B of FIG. 13 and bladders A of FIG. 14). Alternatively, the pressure difference could be achieved by overinflating each bladder desired to be in a relatively high pressure state and leaving the other class of bladders in their pre-existing state of normal inflation, or evacuating air from those bladders. The actual intra-bladder pressures are less important than the difference in pressure between the class A and class B bladders. In other words tissue stretch and shear can be relieved by either reducing pressure in one class of bladders or by increasing pressure in the other class of bladders as long as the relatively lower pressure bladders carry sufficiently little of the occupant's weight to relieve the friction at the occupant/mattress interface.

To ensure complete tissue relaxation, OSIP should be reduced to substantially zero as shown in FIGS. 13 and 14. However more modest pressure reductions may be effective to achieve complete, or at least partial, reduction in shear and tissue stretch. Effective shear mitigation is believed to be obtainable with reductions in OSIP to no more than about 20 mm Hg. Either way, it should be appreciated that reducing OSIP to a particular value does not require reducing intra-bladder inflation pressure to the same value.

In general, tissue is stretched by a stretch force $F_s$. The magnitude of the stretch force per unit area A is proportional to the occupant/support interface pressure, OSIP:

$$Fs/A=\mu_{ss}*\text{OSIP} \quad (1)$$

where $\mu_{ss}$ is the coefficient of friction between the occupant's skin and the mattress surface and A is the contact area between the occupant and the mattress. A restoring force $F_R$ urges the tissue to return to its original, unstretched condition. The magnitude of the restoring force per unit area is proportional to the amount of tissue stretch:

$$F_R/A=k_s/A*x \quad (2)$$

where $k_s$ is the spring constant of the tissue per unit area and x is the distance the tissue is displaced at the occupant/mattress interface The restoring force is sufficient to overcome the stretch force if $F_R$ exceeds $F_S$, i.e. if:

$$k_s/A*x>\mu_{ss}*\text{OSIP} \quad (3)$$

For a given amount of tissue stretch x, OSIP is the only variable in the above inequality. Hence, OFIP must be lowered enough to satisfy the above inequality in order for the occupant's tissue to relax back to it original, unstretched state.

The above described cycle of providing a relatively lower OSIP at a location A and a relatively higher OSIP at a location B followed by providing a relatively higher OSIP at the location A and a relatively lower OSIP at the location B can be repeated multiple times if such repetition is considered desirable. Any frequency slow enough to allow the occupant's tissue to relax back to a substantially unstretched state should be satisfactory. In practice it is expected that the frequency would be no faster than a frequency corresponding to the maximum rate that the flow sources (e.g. compressor 72 and pump 86) can achieve the necessary intra-bladder pressure amplitudes.

Figure 16:
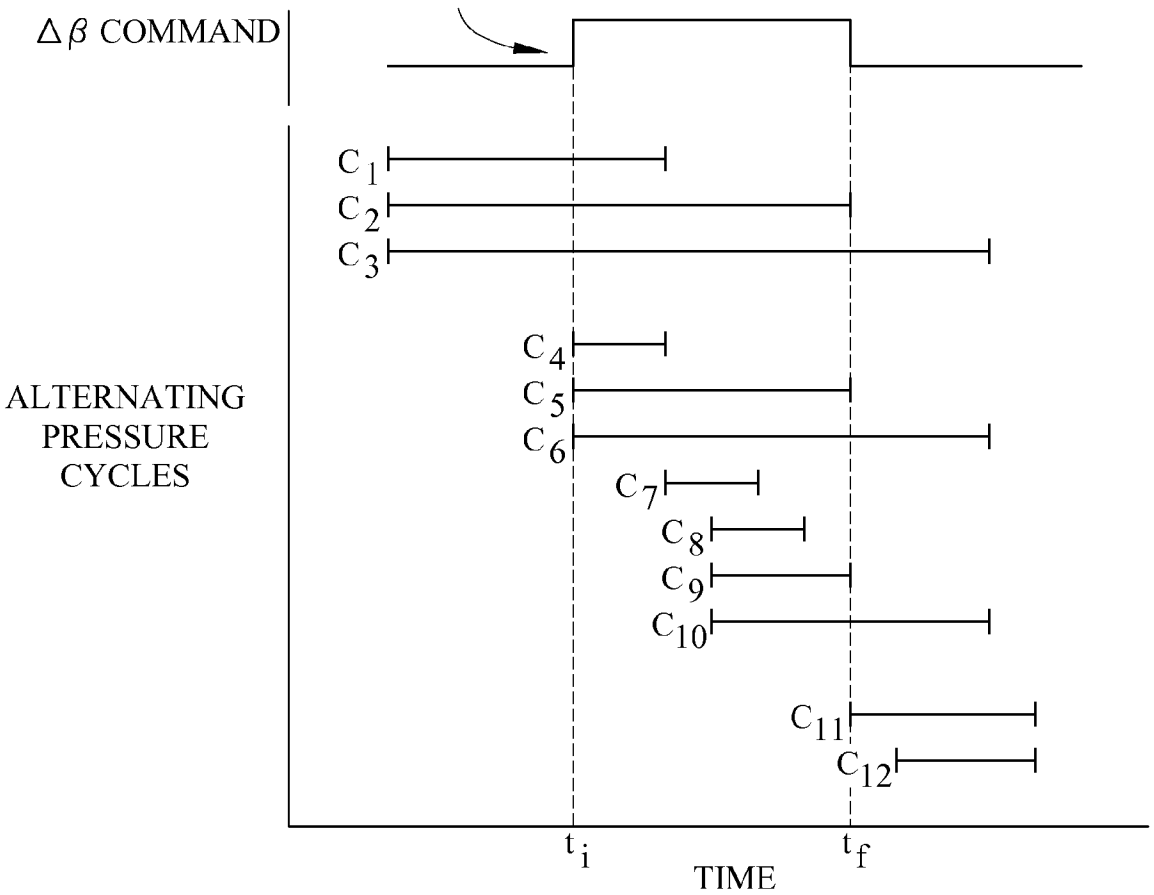
FIG. 16 is a graph showing example temporal sequencings of one or more pressure cycles of the classified bladders in relation to a command for a change in orientation of a section of the bed.

FIG. 16 is a diagram showing a number of options for the temporal sequencing of the above described alternating pressure cycle or cycles relative to a sustained command for the head deck section to change undergo a change of orientation $\Delta\beta$.

In FIG. 16 the $\Delta\beta$ command is present during an orientation change time interval that extends from an initial time $t_i$ to a final time $t_f$. The actions for providing the desired cycles of alternating lower and higher OSIP's, (e.g. opening and/or closing of the supply and/or discharge valves and operation of the compressor and/or pump) define a pressure cycling time interval. Example cycles C1, C2 and C3 all begin prior to $t_i$ and end prior to $t_f$, concurrently with $t_f$, and after $t_f$ respectively. Cycles C4, C5 and C6 all begin concurrently with $t_i$ and end prior to $t_f$, concurrently with $t_f$, and after $t_f$ respectively. Cycle C7 begins after $t_i$ and ends before $t_f$. Cycles C8, C9 and C10 all begin after $t_i$ and end prior to $t_f$, concurrently with $t_f$, and after $t_f$ respectively. Cycle C11 begins at time $t_f$. Cycle C12 begins later than time $t_f$. Alternating pressure cycles that commence prior to $t_i$, (cycles C1, C2, C3) are within the scope of certain of the appended claims, however the portions of the cycles preceding $t_i$ are preemptive portions of the cycle that reduce the OSIP to a level low enough to relieve shear and tissue stretch even before such shear and stretch has occurred. Accordingly, cycles that commence no earlier than when the occupant support is commanded to begin changing orientation are thought to be more effective. Cycles that commence no earlier than when the occupant support is commanded to cease its change of orientation (cycles C11, C12) are believed to be effective, but carry the possible disadvantage of allowing maximum tissue stretch to occur before taking any action to relieve the stretch. This disadvantage is thought to be minor because transient shear and tissue stretch are less troublesome than sustained shear and tissue stretch. Cycles that cease no earlier than when the occupant support is commanded to cease its change of orientation (cycles C2, C3, C5, C6, C9, C10, C11 and C12) have the advantage that the alternating pressure cycle persists at least until the orientation change ceases. Cycles that extend temporally beyond the time $t_f$ that the occupant support is commanded to cease its change of orientation (cycles C3, C6, C10, C11, C12) provide additional opportunity to relieve any residual stretch that might not have been addressed by the earlier portion of the cycle. The temporal extension also addresses any tissue stretch that occurs after time $t_f$. Such stretching might occur, for example, if the occupant's inertia causes him or her to continue migrating longitudinally along the mattress for a time interval after the orientation change ceases or is commanded to cease. Cycles that at least partially overlap the orientation change time interval (all cycles except C11 and C12) have the advantage that the alternating pressure cycles occur during at least part of the time interval during which the occupant is most susceptible to tissue stretch. However as already noted, the advantage may be minor because transient shear and tissue stretch is less damaging than sustained shear and tissue stretch. For the same reason, cycles C11 and C12 are thought to be highly satisfactory.

It should be appreciated that whether or not an orientation change of a given magnitude imparts any noteworthy tissue stretch may be a function of the change of orientation $\Delta\beta$, the initial orientation $\beta_{initial}$ or both. Accordingly, it may be satisfactory to provide the alternating pressure cycles only if the orientation adjustable portion of the occupant support is commanded to change orientation by at least a prescribed amount and/or the initial orientation $\beta_{initial}$ satisfies prescribed criteria during a single occupant support orientation change event. A single orientation change event is defined as the issuance and subsequent recission of an orientation change command (e.g. by pressing and later releasing the appropriate key on keypad 54) interrupted by zero or more issuance/recission sub-events none of which has a duration of more than a defined time interval. This accounts for the possibility of a user who intends to command a change of orientation from, for example, 10° to 40°, but momentarily releases pressure on the command for less than the defined time interval during the orientation change event. The controller 100 would not recognize the momentary release as a pause between two distinct events, but would instead recognize a single event.

The foregoing explanation of possible temporal relationships between the alternating pressure cycle and the orientation change is based on the commanded orientation change However the relationships could instead be based on actual change in orientation (e.g. of the head deck section 44). In other words determinations related to the orientation of the orientation adjustable part of the occupant support can be based on determinations of an actual orientation rather than on the commanded orientation, and determinations related to changes in the orientation of the orientation adjustable part of the occupant support can be based on determinations of actual changes in an orientation rather than commanded change in orientation.

Figure 17A:
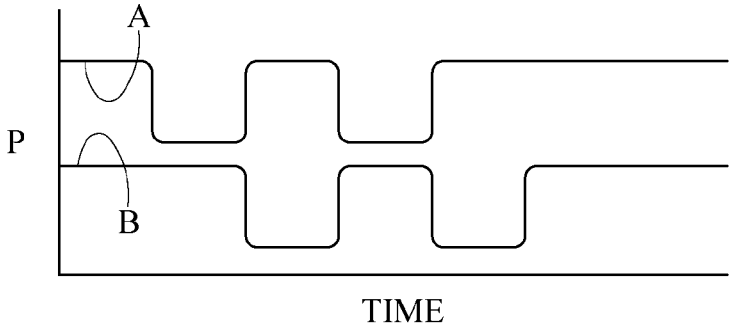
FIGS. 17A-17D are graphs showing example phase relationships between the intrabladder pressures of classified bladders during pressure cycling of the bladders.
Figure 17B:
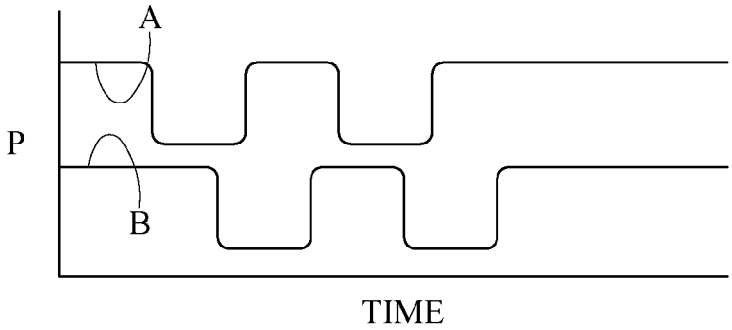
Figure 17C:
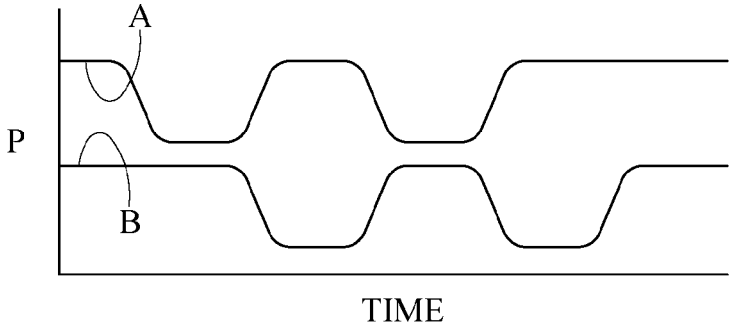
Figure 17D:
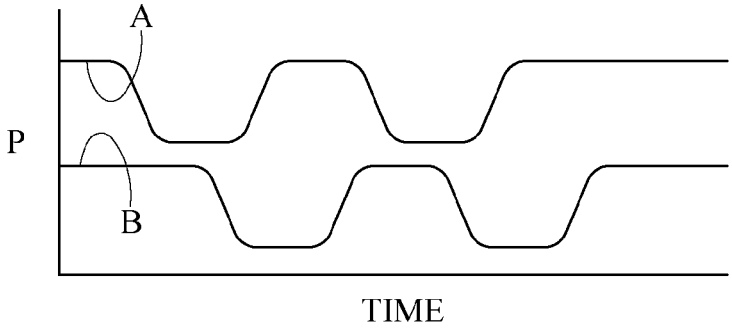

FIGS. 17A through 17D are graphs showing example waveforms of various intra-bladder pressure cycles and the phase relationship between bladders of different classes A and B. Occupant/support interface pressure would exhibit a similar waveform and phase relationship. FIG. 17A shows a substantially square-wave waveform in which the A and B bladder pressures are out of phase with each other by one-half cycle. That is, the A bladder pressure is high when the B bladder pressure is low and vice versa. This is believed to be the optimum waveform and phase relationship for effective shear and tissue stretch relief. FIG. 17B shows waveforms similar to those of FIG. 17A, but with the A and B waveforms phase shifted by approximately one-third of a cycle. FIG. 17C shows non-square-wave waveforms with a half-cycle phase difference. FIG. 17D shows non-square-wave waveforms with a one-third cycle phase difference. Non-square waves, such as sinusoidal waves and those of FIGS. 17B through 17D, have the practical advantage over square waves of requiring lower airflow rates and therefore being easier to achieve.

Figure 18:
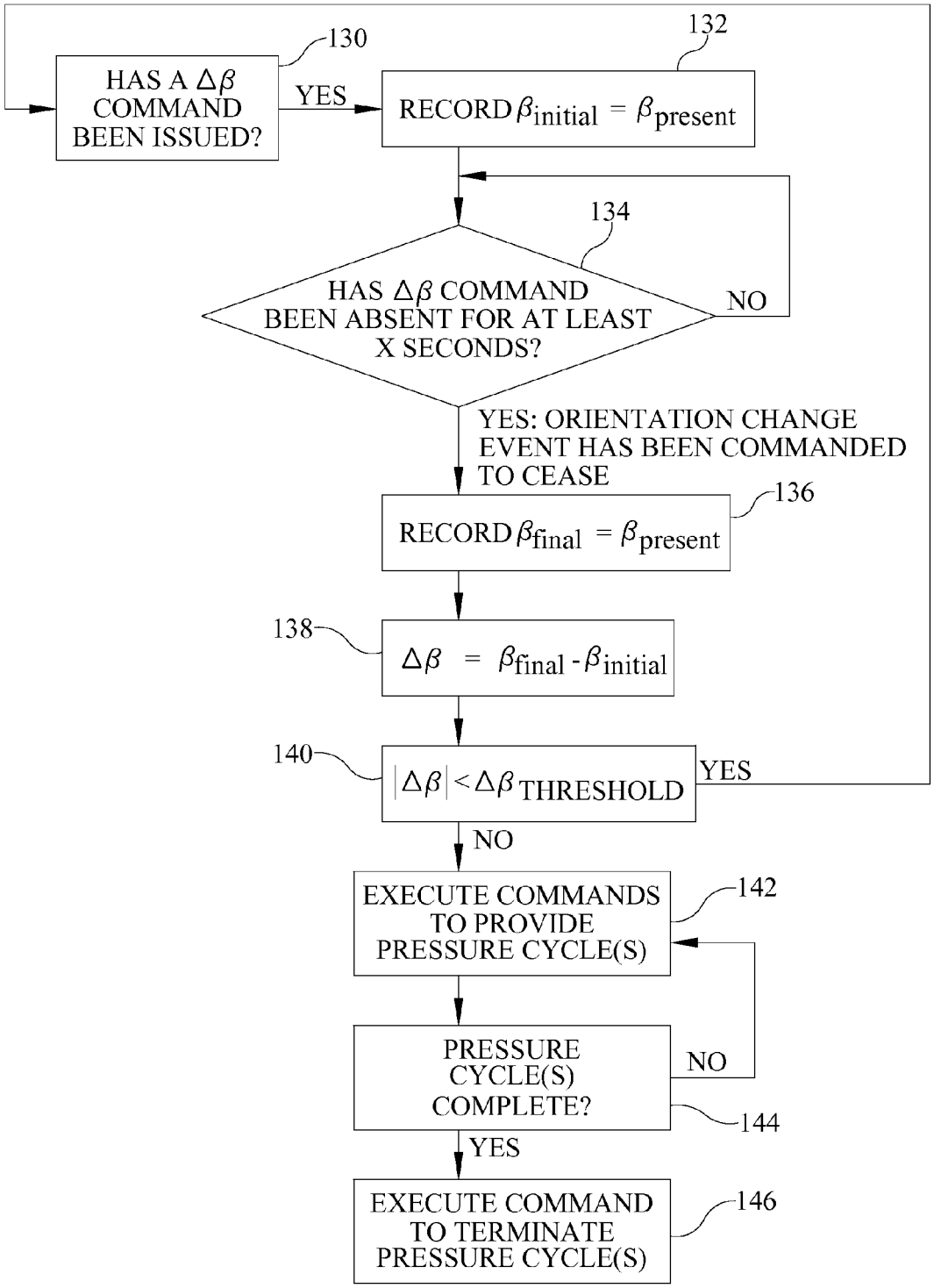
FIG. 18 is a flow diagram showing one possible algorithm for carrying out one or more alternating pressure cycles of classified air bladders in response to a commanded or actual change in orientation of a section of the bed.

FIG. 18 is a flow diagram illustrating a control algorithm for carrying out an alternating pressure cycle in response to a commanded or actual change in orientation. Block 130 determines if a command to change the orientation of the head deck section has been issued, for example the application of pressure to an appropriate key on the user keypad 54. If so, the algorithm records the existing angular orientation as $\beta_{initial}$ at block 132. At block 134 the algorithm monitors whether or not the orientation adjustment event has ended or is still underway. If the algorithm determines that the orientation change command has been absent for a defined period of time or longer, the algorithm concludes that the user has intentionally released pressure on the control key and proceeds to block 136. However if the command is briefly interrupted (i.e. becomes absent and then re-appears before the defined time interval has elapsed) the algorithm concludes that the interruption was unintentional and continues to monitor for an intentional removal of the command.

At block 136 the algorithm records the existing angular orientation of the deck section as $\beta_{final}$. At block 138 the algorithm calculates the change in angular orientation $\Delta\beta$. At block 140 the algorithm compares the magnitude (absolute value) of the angular change $|\Delta\beta|$ to a threshold angular change $\Delta\beta_{THRESHOLD}$. If the magnitude is less than the threshold, the algorithm refrains from commanding an alternating pressure cycle. If the magnitude equals or exceeds the threshold value the algorithm issues commands to provide one or more alternating pressure cycles (block 142), for example by appropriately opening and closing the supply and discharge valves and operating and refraining from operating the compressor and pump. Once the cycles have been completed (block 144) the algorithm terminates the pressure cycles (block 146).

In view of the foregoing description certain other features and variations on the theme can now be better appreciated. For example, although the method and apparatus have been described in the context of changing the orientation of the head section of a bed, the principles taught herein can be applied to other sections and can, if desired, be applied in conjunction with changes in the inclination $\alpha$ of the bed frame.

Figure 19:
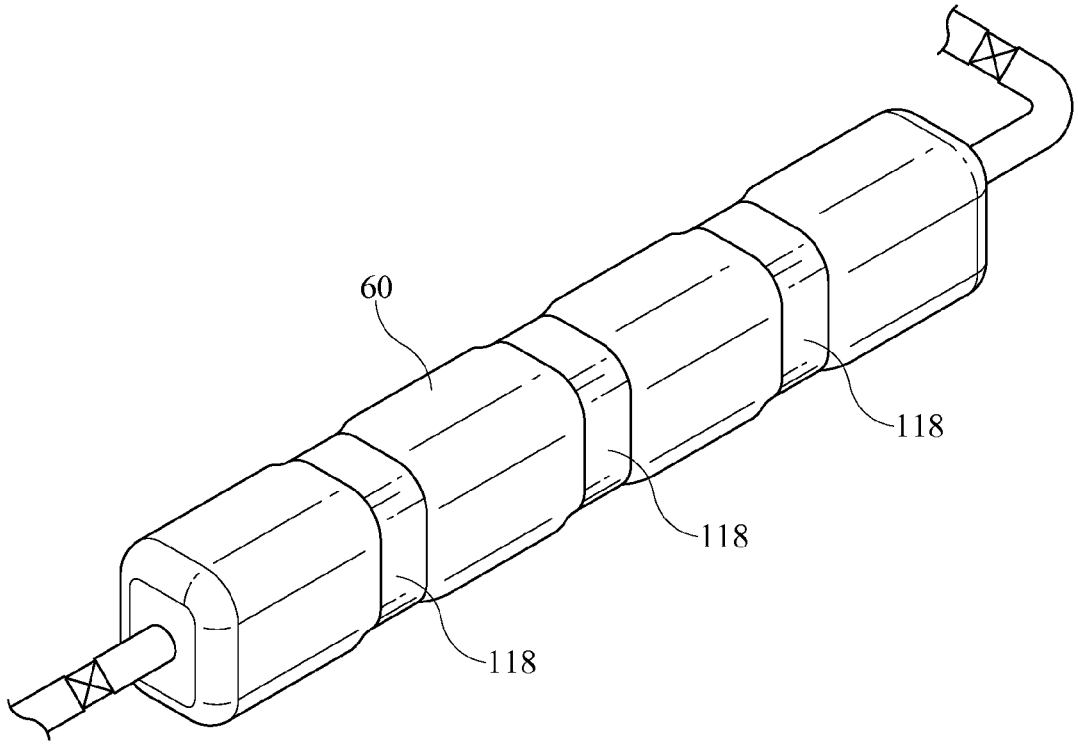
FIG. 19 is a perspective view of an air bladder circumscribed by elastic bands for accelerating evacuation of intrabladder air.

The illustrated embodiments employ pump 86 to rapidly evacuate the bladders. However the pump could, in principle, be dispensed with in favor of a passive vent. In such an arrangement it may be advisable to include other components to encourage rapid depressurization of the bladders. FIG. 19 shows one possible arrangement using an elastic element, in the form of elastic bands 118 stretching around the bladders when the bladders are inflated. When the passive vent is opened the bands help accelerate the evacuation of the intra-bladder air.

A bladder aspect ratio of at least 1.5 is believed to be desirable in order to be able to achieve rapid bladder depressurization, and accompanying reduction of OSIP to satisfactory levels, with only modest bladder inflation pressure. Modest bladder pressure reduces demands on the compressor and reduces the likelihood of bladder rupture. Higher aspect ratios require less intra-bladder pressure change to unload enough of the occupant's weight from the relatively lower pressure bladders to reduce OSIP sufficiently to relieve the shear and tissue stretch.

Portions of the present application refer to the occupant/mattress interface and the coefficient of friction between the occupant's skin and the mattress surface. In practice, the occupant is usually clothed in sleepwear so that the interface is more precisely thought of as a combined occupant/sleepwear/mattress interface. Moreover, although one can envision an overall coefficient of friction between the skin and the mattress surface, the presence of the occupant's sleepwear makes the interface more complicated. Nevertheless, the use of the simpler concept of occupant/mattress interface and a coefficient of friction between the occupant's skin and the mattress surface is a useful idealization that exposes the underlying principles of the subject matter described and claimed herein without defeating the scope of applicability of the teachings and the claimed subject matter.

Although this disclosure refers to specific embodiments, it will be understood by those skilled in the art that various changes in form and detail may be made without departing from the subject matter set forth in the accompanying claims.

I claim:

1. A method of operating an occupant support at least part of which is orientation adjustable relative to other parts of the occupant support, the method comprising:

providing, in response to a change of orientation of the orientation adjustable part, a relatively lower occupant/support interface pressure (OSIP) at a location A and a relatively higher OSIP at a location B followed by providing a relatively higher OSIP at the location A and a relatively lower OSIP at the location B.

2. The method of claim 1 comprising multiple cycles of providing relatively lower and higher OSIP at the locations A and B.

3. The method of claim 1 wherein providing relatively lower OSIP comprises reducing OSIP to substantially zero.

4. The method of claim 1 wherein the locations A and B have a longitudinal dimension and a lateral dimension and wherein the longitudinal dimension exceeds the lateral dimension.

5. The method of claim 1 wherein the locations A and B have a longitudinal dimension and a lateral dimension and wherein the lateral dimension exceeds the longitudinal dimension.

6. The method of claim 1 wherein the locations A and B are arranged as a lattice having a lateral lattice dimension N with N >1 and a longitudinal lattice dimension M with M >1.

7. The method of claim 1 wherein action to provide the relatively lower and higher OSIP commences no earlier than when the occupant support is commanded to begin changing orientation.

8. The method of claim 1 wherein action to provide the relatively lower and higher OSIP commences no earlier than when the occupant support is commanded to cease its change of orientation.

9. The method of claim 1 wherein action to provide the relatively lower and higher OSIP ceases no earlier than when the occupant support is commanded to cease its change of orientation.

10. The method of claim 1 wherein:

action to provide the relatively lower and higher OSIP occurs during a pressure cycling time interval;

the occupant support is commanded to change orientation during an orientation change time interval; and the pressure cycling time interval and the orientation change time interval at least partially overlap.

11. The method of claim 1 wherein actions to provide the relatively lower and higher OSIP are scheduled to occur only if the orientation adjustable portion of the occupant support changes orientation or is commanded to change orientation by at least a prescribed amount during a single occupant support orientation change event.

12. The method of claim 11 wherein the single occupant support orientation change event comprises issuance and recission of an orientation change command interrupted by zero or more issuance/recission sub-events none of which has a duration of more than a defined time interval.

13. The method of claim 1 wherein:

determinations related to orientation of the orientation adjustable part of the occupant support are based on determinations of an actual orientation; and determinations related to changes in the orientation of the orientation adjustable part of the occupant support are based on determinations of actual changes in an orientation.

* * * * *